US011882904B2

(12) United States Patent
Avar et al.

(10) Patent No.: US 11,882,904 B2
(45) Date of Patent: Jan. 30, 2024

(54) AUTOLACING FOOTWEAR HAVING A SLIDING SECURING DEVICE

(71) Applicant: NIKE, Inc., Beaverton, OR (US)

(72) Inventors: Eric P. Avar, Lake Oswego, OR (US); Summer L. Schneider, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 289 days.

(21) Appl. No.: 16/696,522

(22) Filed: Nov. 26, 2019

(65) Prior Publication Data

US 2020/0170352 A1 Jun. 4, 2020

Related U.S. Application Data

(60) Provisional application No. 62/773,379, filed on Nov. 30, 2018.

(51) Int. Cl.
*A43C 11/12* (2006.01)
*A43C 1/00* (2006.01)
(Continued)

(52) U.S. Cl.
CPC ..... *A43C 11/12* (2013.01); *A43B 3/34* (2022.01); *A43C 1/00* (2013.01); *A43C 11/165* (2013.01)

(58) Field of Classification Search
CPC ..... A43C 11/165; A43C 11/12
See application file for complete search history.

(56) References Cited

U.S. PATENT DOCUMENTS 3,491,465 A * 1/1970 Hans ..... A43C 11/008 D2/904
5,327,662 A 7/1994 Hallenbeck
(Continued)

FOREIGN PATENT DOCUMENTS

CN 2438353 7/2001
CN 101600363 12/2009
(Continued)

OTHER PUBLICATIONS

"International Application Serial No. PCT US2019 063352, International Search Report dated Apr. 29, 2020", 4 pgs.
(Continued)

*Primary Examiner* — Jila M Mohandesi
(74) *Attorney, Agent, or Firm* — Schwegman, Lundberg & Woessner, P.A.

(57) ABSTRACT

An article of footwear and method of manufacturing includes a midsole, an upper, secured with respect to the midsole, forming an opening to admit a foot of a wearer, the opening being adjustable between a first segment of the upper and a second segment of the upper to secure the article of footwear to the foot of the wearer, and a slidable securing device. The slidable securing device is coupled between the first segment and the second segment of the upper, configured to slide along a length of track and secure the first and second segments together. A motorized lacing system engages with a lace to increase and decrease tension on the lace. The lace is secured to the slidable securing device, and when tension is placed on the lace, the lace causes the slidable securing device to slide along the track and secure the first and second segments together.

10 Claims, 10 Drawing Sheets

(51) Int. Cl.

| | |
|---|---|
| ***A43B 3/00*** | (2022.01) |
| ***A43B 3/34*** | (2022.01) |
| ***A43C 11/16*** | (2006.01) |

(56) References Cited

U.S. PATENT DOCUMENTS

| | | | | |
|---|---|---|---|---|
| 5,839,210 | A * | 11/1998 | Bernier | A43B 3/0078 36/138 |
| 9,480,299 | B2 * | 11/2016 | Dinndorf | A43B 23/07 |
| 11,197,519 | B2 * | 12/2021 | Dombrow | A43B 7/226 |
| 11,330,868 | B2 * | 5/2022 | Innocente | A43C 11/008 |
| 2008/0086911 | A1 * | 4/2008 | Labbe | A43C 11/008 36/50.1 |
| 2008/0307673 | A1 | 12/2008 | Johnson | |
| 2009/0199435 | A1 * | 8/2009 | Robinson, Jr. | A43C 11/165 36/108 |
| 2009/0272007 | A1 * | 11/2009 | Beers | A43C 11/14 36/50.1 |
| 2015/0289594 | A1 | 10/2015 | Rushbrook et al. | |
| 2015/0289596 | A1 | 10/2015 | Beers et al. | |
| 2017/0265579 | A1 | 9/2017 | Schneider et al. | |
| 2017/0265593 | A1 | 9/2017 | Schneider et al. | |

FOREIGN PATENT DOCUMENTS

| | | |
|---|---|---|
| CN | 102014682 | 4/2011 |
| CN | 106896911 | 6/2017 |
| CN | 107568835 | 1/2018 |
| CN | 206852168 | 1/2018 |
| CN | 108577017 | 9/2018 |
| CN | 113163889 | 7/2021 |
| JP | 2022510955 | 1/2022 |
| KR | 100807105 | 2/2008 |
| KR | 20110106772 | 9/2011 |
| KR | 20210087060 | 7/2021 |
| WO | 2018170116 | 9/2018 |
| WO | 2020112841 | 6/2020 |

OTHER PUBLICATIONS

"International Application Serial No. PCT US2019 063352, Written Opinion dated Apr. 29, 2020", 5 pgs.

"European Application Serial No. 19888419.9, Response to Communication Pursuant to Rules 161 and 162 EPC filed Jan. 17, 2022", 11 pgs.

"International Application Serial No. PCT US2019 063352, International Preliminary Report on Patentability dated Jun. 10, 2021", 7 pgs.

"European Application Serial No. 19888419.9, Extended European Search Report dated Jul. 7, 2022", 8 pgs.

"Chinese Application Serial No. 201980077770.7, Office Action dated Sep. 20, 2022", With English translation, 16 pgs.

"Korean Application Serial No. 10-2021-7016444, Voluntary Amendment filed Nov. 22, 2022", w English claims, 14 pgs.

"European Application Serial No. 19888419.9, Communication Pursuant to Article 94(3) EPC dated Mar. 9, 2023", 6 pgs.

"Chinese Application Serial No. 201980077770.7, Response filed Apr. 6, 2023 to Office Action dated Sep. 20, 2022", w English claims, 10 pgs.

"Japanese Application Serial No. 2021-531052, Voluntary Amendment filed Dec. 13, 2022", w English claims, 11 pgs.

"European Application Serial No. 19888419.9, Response filed Jan. 26, 2023 to Extended European Search Report dated Jul. 7, 2022", 29 pgs.

"European Application Serial No. 19888419.9, Response filed Jul. 19, 2023 to Communication Pursuant to Article 94(3) EPC dated Mar. 9, 2023", 32 pgs.

"Chinese Application Serial No. 201980077770.7, Office Action dated Aug. 9, 2023", With English machine translation, 11 pgs.

"Japanese Application Serial No. 2021-531052, Notification of Reasons for Refusal dated Nov. 14, 2023", With English machine translation, 8 pgs.

* cited by examiner

AUTOLACING FOOTWEAR HAVING A SLIDING SECURING DEVICE

PRIORITY APPLICATIONS

This application claims the benefit of priority to U.S. Provisional Patent Application Ser. No. 62/773,379, filed Nov. 30, 2018, the content of which is incorporated herein by reference in its entirety.

TECHNICAL FIELD

The subject matter disclosed herein generally relates to an article of footwear having an autolacing motor and a sliding securing device.

DETAILED DESCRIPTION

Articles of footwear, such as shoes, may include a variety of components, both conventional and unconventional. Conventional components may include an upper, a sole, and laces or other securing mechanisms to enclose and secure the foot of a wearer within the article of footwear. Unconventionally, a motorized lacing system may engage with the lace to tighten and/or loosen the lace. Additional or alternative electronics may provide a variety of functionality for the article of footwear, including operating and driving the motor, sensing information about the nature of the article of footwear, providing lighted displays and/or other sensory stimuli, and so forth.

BRIEF DESCRIPTION OF THE DRAWINGS

Some embodiments are illustrated by way of example and not limitation in the figures of the accompanying drawings.

DETAILED DESCRIPTION

Example methods and systems are directed to an article of footwear having an autolacing motor and a sliding securing device. Examples merely typify possible variations. Unless explicitly stated otherwise, components and functions are optional and may be combined or subdivided, and operations may vary in sequence or be combined or subdivided. In the following description, for purposes of explanation, numerous specific details are set forth to provide a thorough understanding of example embodiments. It will be evident to one skilled in the art, however, that the present subject matter may be practiced without these specific details.

Articles of footwear, such as shoes, may include a variety of components, both conventional and unconventional. Conventional components may include an upper, a sole, and laces or other securing mechanisms to enclose and secure the foot of a wearer within the article of footwear. Unconventionally, a motorized lacing system may engage with the lace to tighten and/or loosen the lace. Additional or alternative electronics may provide a variety of functionality for the article of footwear, including operating and driving the motor, sensing information about the nature of the article of footwear, providing lighted displays and/or other sensory stimuli, and so forth.

In general, and particularly for articles of footwear oriented toward the performance of athletic activities, characteristics such as the size, form, robustness, and weight of the article of footwear may be of particular importance. The capacity to firmly secure the article of footwear to the foot by way of tightening a lace, laces, or other tension members may further enhance wearability, comfort, and performance. Providing adequate tightness across a desired range of the upper of a footwear may be a particular challenge of autolacing footwear and footwear in general.

Autolacing footwear has been developed that seeks to promote securing of the article of footwear to a foot through the use of slidable securing devices, such as zippers and the like. A lace engages both with a motor and spool as well as with the slidable securing device. By engaging the motor and turning the spool, force on the lace is transferred to the slidable securing device, causing the slidable securing device to automatically close and promote securing of the article of footwear to the foot. The lace may also extend through lace guides to further promote securing the article of footwear to the foot.

Figure 1:
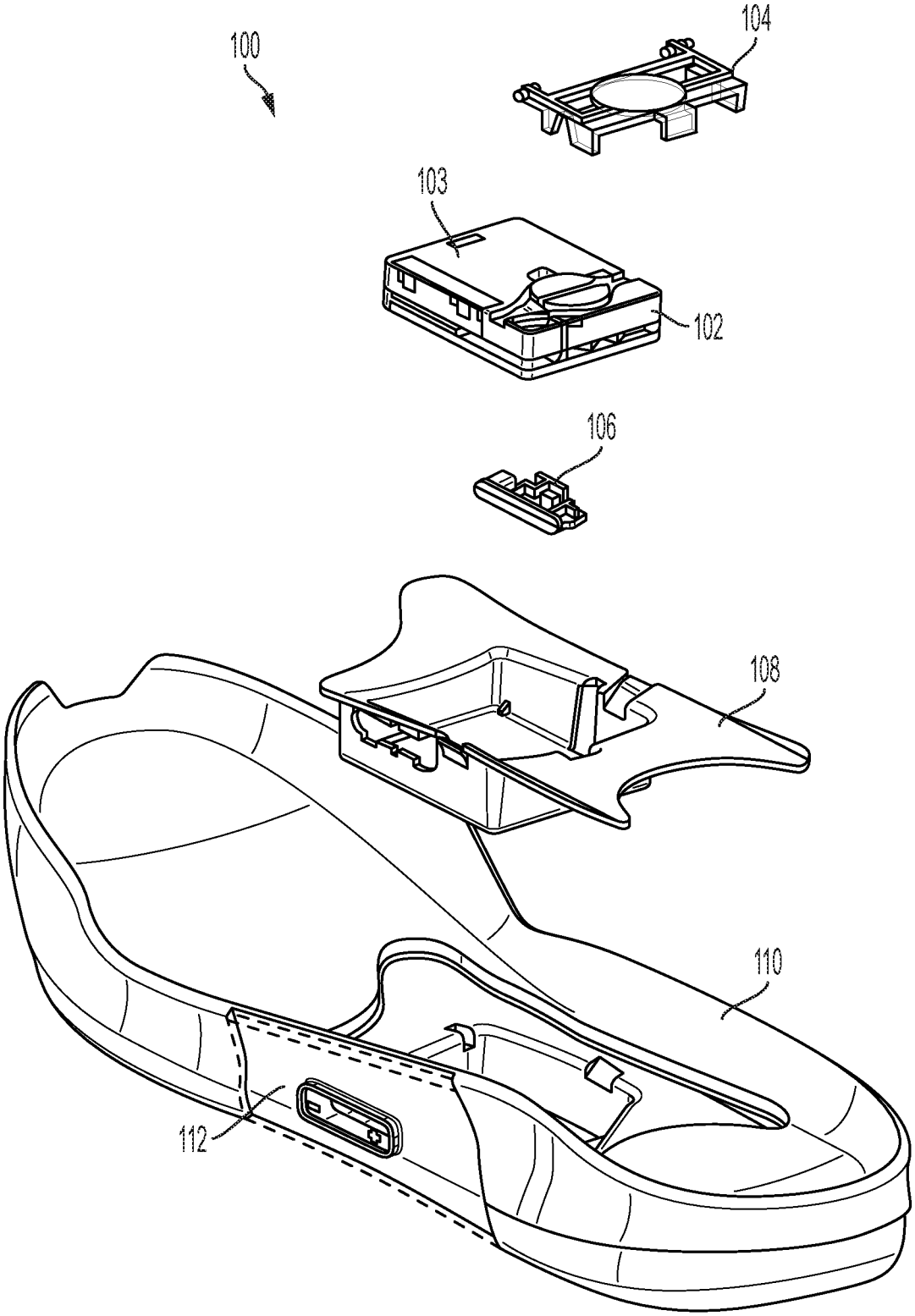
FIG. 1 is an exploded view illustration of components of a motorized lacing system for an article of footwear, in an example embodiment.

FIG. 1 is an exploded view illustration of components of a motorized lacing system for an article of footwear, in an example embodiment. While the system is described with respect to the article of footwear, it is to be recognized and understood that the principles described with respect to the article of footwear apply equally well to any of a variety of wearable articles. The motorized lacing system 100 illustrated in FIG. 1 includes a lacing engine 102 having a housing structure 103, a lid 104, an actuator 106, a mid-sole plate 108, a mid-sole 110, and an outsole 112. FIG. 1 illustrates the basic assembly sequence of components of an automated lacing footwear platform. The motorized lacing system 100 starts with the mid-sole plate 108 being secured within the mid-sole. Next, the actuator 106 is inserted into an opening in the lateral side of the mid-sole plate opposite to interface buttons that can be embedded in the outsole 112. Next, the lacing engine 102 is dropped into the mid-sole plate 108. In an example, the lacing system 100 is inserted under a continuous loop of lacing cable and the lacing cable is aligned with a spool in the lacing engine 102 (discussed below). Finally, the lid 104 is inserted into grooves in the mid-sole plate 108, secured into a closed position, and latched into a recess in the mid-sole plate 108. The lid 104 can capture the lacing engine 102 and can assist in maintaining alignment of a lacing cable during operation. A lace spool 220 (see FIG. 2) is under the lid 104.

Figure 2:
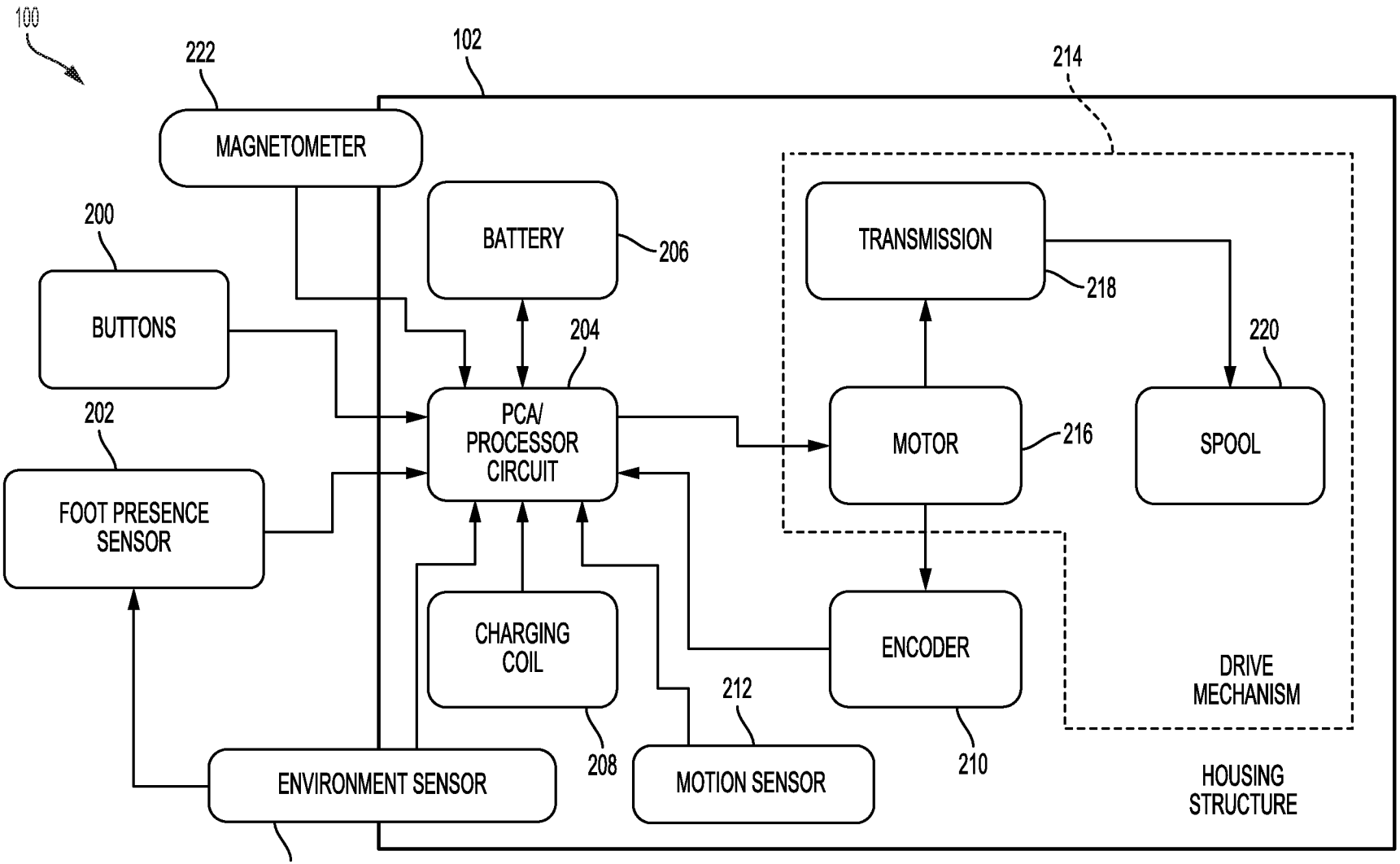
FIG. 2 illustrates generally a block diagram of components of a motorized lacing system, in an example embodiment.

FIG. 2 illustrates generally a block diagram of components of a motorized lacing system 100, in an example embodiment. The system 100 includes some, but not necessarily all, components of a motorized lacing system such as including interface buttons 200, a foot presence sensor 202, and the lacing engine housing 102 enclosing a printed circuit board assembly (PCA) with a processor circuit 204, a battery 206, a receive coil 208, an optical encoder 210, a motion sensor 212, and a drive mechanism 214. The optical encoder 210 may include an optical sensor and an encoder having distinct portions independently detectable by the optical sensor. The drive mechanism 214 can include, among other things, a motor 216, a transmission 218, and a lace spool 220. The motion sensor 212 can include, among other things, a single or multiple axis accelerometer, a magnetometer, a gyrometer, or other sensor or device configured to sense motion of the housing structure 102, or of one or more components within or coupled to the housing structure 102. In an example, the motorized lacing system 100 includes a magnetometer 222 coupled to the processor circuit 204.

In the example of FIG. 2, the processor circuit 204 is in data or power signal communication with one or more of the interface buttons 200, foot presence sensor 202, battery 206, receive coil 208, and drive mechanism 214. The transmission 218 couples the motor 216 to a spool to form the drive mechanism 214. In the example of FIG. 2, the buttons 200, foot presence sensor 202, and environment sensor 224 are shown outside of, or partially outside of, the lacing engine 102.

In an example, the receive coil 208 is positioned on or inside of the housing 103 of the lacing engine 102. In various examples, the receive coil 208 is positioned on an outside major surface, e.g., a top or bottom surface, of the housing 103 and, in a specific example, the bottom surface. In various examples, the receive coil 208 is a qi charging coil, though any suitable coil, such as an A4WP charging coil, may be utilized instead.

In an example, the processor circuit 204 controls one or more aspects of the drive mechanism 214. For example, the processor circuit 204 can be configured to receive information from the buttons 200 and/or from the foot presence sensor 202 and/or from the motion sensor 212 and, in response, control the drive mechanism 214, such as to tighten or loosen footwear about a foot. In an example, the processor circuit 204 is additionally or alternatively configured to issue commands to obtain or record sensor information, from the foot presence sensor 202 or other sensor, among other functions. In an example, the processor circuit 204 conditions operation of the drive mechanism 214 on (1) detecting a foot presence using the foot presence sensor 202 and (2) detecting a specified gesture using the motion sensor 212.

Information from the environment sensor 224 can be used to update or adjust a baseline or reference value for the foot presence sensor 202. As further explained below, capacitance values measured by a capacitive foot presence sensor can vary over time, such as in response to ambient conditions near the sensor. Using information from the environment sensor 224, the processor circuit 204 and/or the foot presence sensor 202 can update or adjust a measured or sensed capacitance value.

Figure 3:
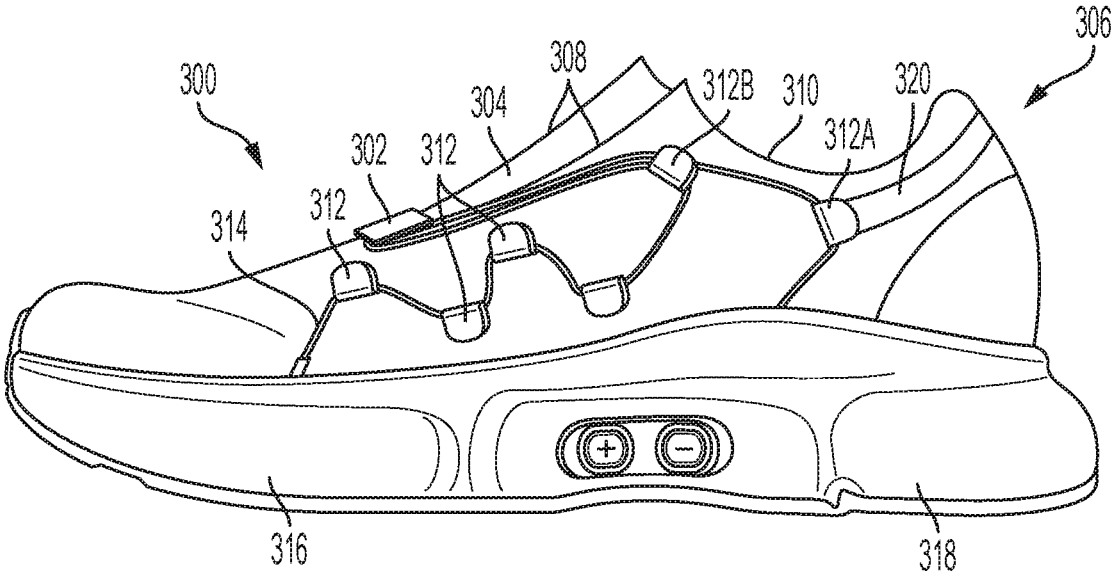
FIG. 3 is a depiction of an article of footwear incorporating a motorized lacing system and a slidable securing device, in an example embodiment.

FIG. 3 is a depiction of an article of footwear 300 incorporating the motorized lacing system 100 and a slidable securing device 302, in an example embodiment. The slidable securing device 302 is positioned over and along a throat 304 of an upper 306 of the article of footwear 300. The slideable securing device 302 is positioned on or includes a track 308 that extends along the throat 304 and ends proximate a collar 310 of the upper 306. In various examples, the slideable securing device 302 is a zipper, though any of a variety of related or otherwise suitable devices are contemplated.

The article of footwear includes a lacing architecture that includes multiple lace guides 312 through which a lace 314 extends. While only one side of the article of footwear 300 is depicted, the lace guides 312 may extend down a medial and lateral side. The lace 314 is secured to the article of footwear 300 at each end at a securing point 316, e.g., by being sewn or glued, on each of the medial and lateral sides of the article of footwear 300. Portions of the upper 306 between and around the lace guides 312 may be made from a flexible, elastic, or otherwise stretchable material that would allow the lace guides 312 to move relative to one another as a force is imparted on them by the lace 314, as will be illustrated in detail herein.

A midsection of the lace 314 passes under the upper 306 at a midsole region 318 and is positioned in and engages with the drive mechanism 214 (not pictured) by way of the spool 220. From the midsole region 318, the lace extends past a heel lace guide 312A, through a collar lace guide 312B, and then extends through and engages with the slidable securing device 302. The lace 314 then returns to the collar lace guide 312 and forms a zig-zag pattern through the remaining lace guides 312 before being secured at the securing point 316. As will be shown in detail herein, the activation of the drive mechanism 214 may impart a force that draws the slidable securing device 302 along the track 308, cause the lace guides 312 to be drawn together, and impart a force on a heel strap 320 to which the heel lace guide 312A is attached, all of which may tend to secure the article of footwear 300 to a foot of a wearer.

FIGS. 4A-4D illustrate a process by which the article of footwear 300 is tightened, in an example embodiment.

Figure 4A:
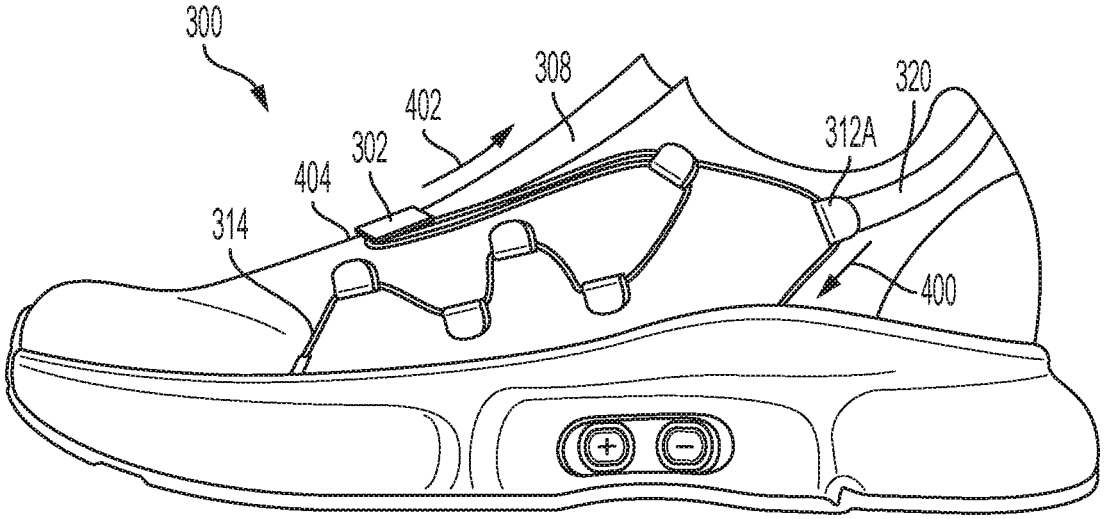
FIGS. 4A-4D illustrate a process by which an article of footwear is tightened, in an example embodiment.

In FIG. 4A, the article of footwear 300 is in a fully loosened configuration. When the motor 216 (not pictured) is activated to tighten the lace 314 the spool 220 (not pictured) turns and the lace 314 is tightened about the spool 220. The spooling of the lace 314 imparts a force 400 on the lace 314, which imparts a force 402 on the slidable securing device 302, which begins at a proximal end 404 of the track 308, tending to draw the slidable securing device 302 along the track 308. A force may also be imparted on the heel strap 320 to which the heel lace guide 312A is attached.

Figure 4B:
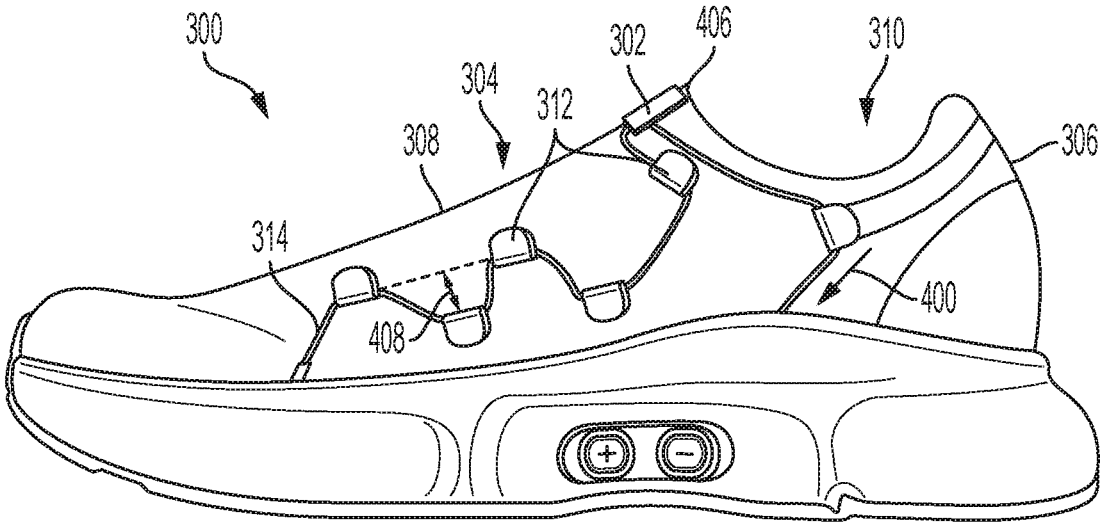

In FIG. 4B, the slidable securing device 302 has just been drawn along the track 308 to a distal end 406 of the track 308, close to the collar 310. The throat 304 of the upper 306 is closed thereby, causing a foot (not pictured) to be partially secured within the upper 306. It is noted that the force 400 on the lace 314 has not yet resulted in an appreciable force being imparted on the lace guides 312, and a vertical distance 408 between the lace guides 312 is not substantially changed.

Figure 4C:
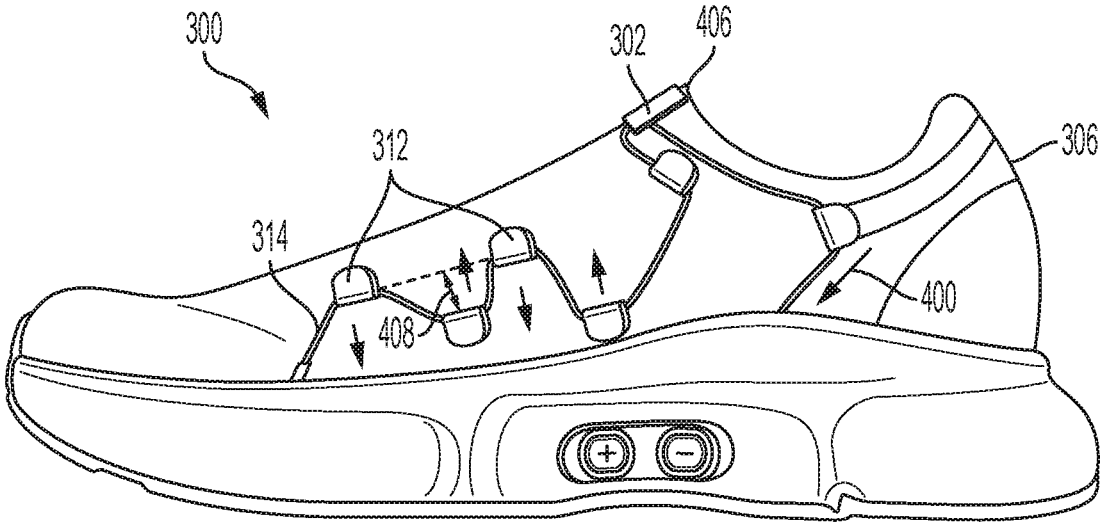

In FIG. 4C, with the slidable securing device 302 at the distal end 406, the continued force 400 on the lace 314 by the motor 212 is imparted onto the lace guides 312, with the force 400 on the lace guides drawing the lace guides 312 together and causing the vertical distance 408 between the lace guides 312 to decrease relative to the vertical distance 408 of the lace guides 312 in FIGS. 4A and 4B. In so doing, the upper 306 may be further enclosed around and secured to the foot of the wearer.

Figure 4D:
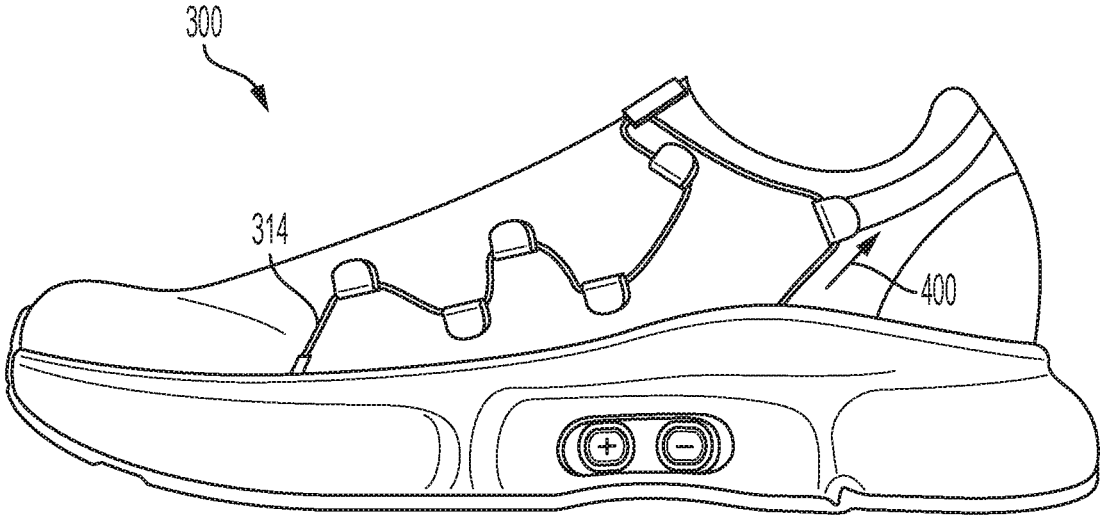

In FIG. 4D, the motor 212 has ceased causing the spool 214 to turn. However, the force 400 remains on the lace 314 to maintain the tension on the lace 314, maintaining the article of footwear 300 in a secured state. The force 400 remains on the lace 314 until the motor 212 causes the spool 214 to turn to release tension on the lace 314.

Figure 5A:
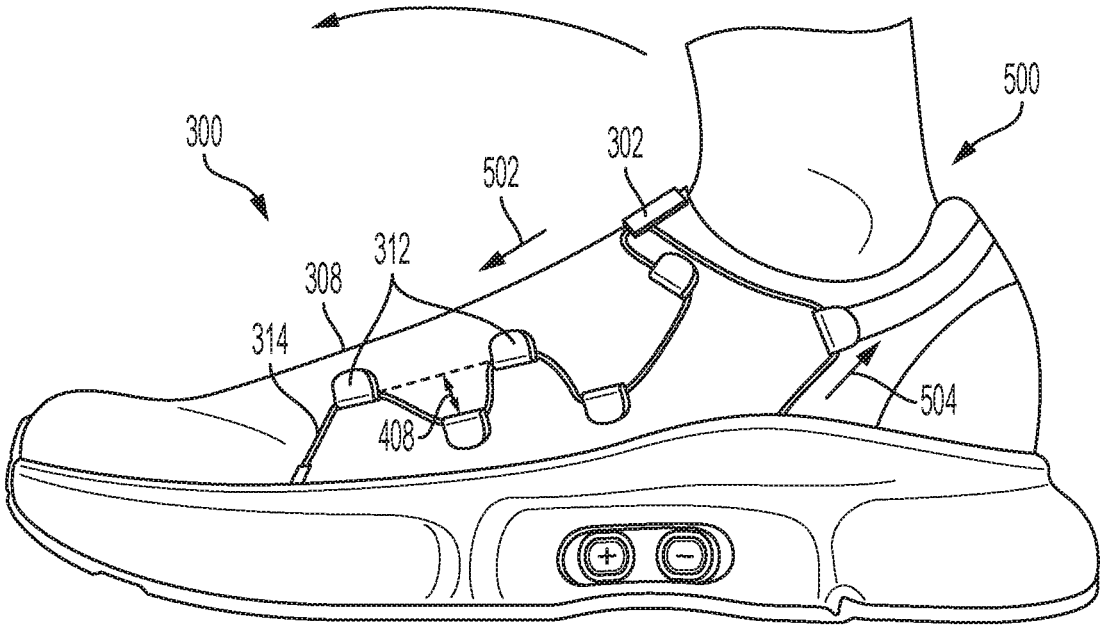
FIGS. 5A and 5B are a depiction of an article of footwear having elongate spools that are flexible, in an example embodiment.
Figure 5B:
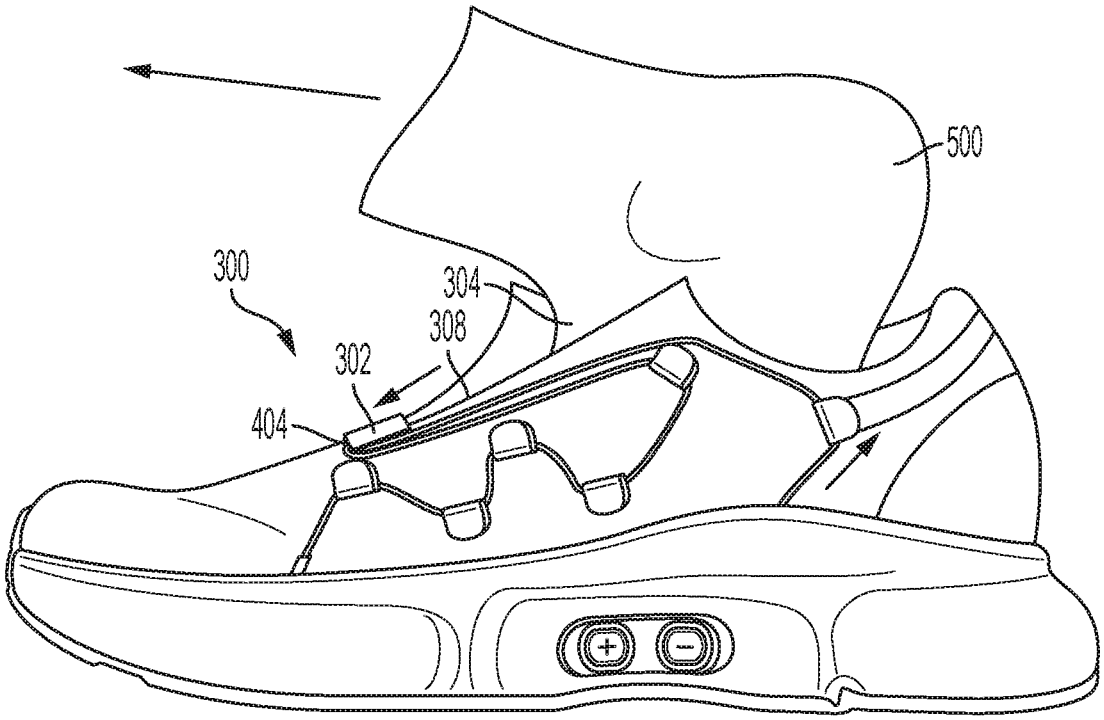

FIGS. 5A and 5B illustrate a loosening of the lace 314 to allow a foot 500 of a wearer to be removed from the article of footwear 300, in an example embodiment. In the illustration of FIGS. 5A and 5B, the article of footwear 300 has already been through the process illustrated in FIGS. 4A-4D.

In FIG. 5A, the motor 212 (not pictured) has activated to cause the spool 214 (not pictured) to turn and unspool the lace 314, thereby releasing the tension on the lace 314. In various examples, friction imposed on the lace 314 by the lace guides 312 and other components of the article of footwear 300 do not automatically place a force on the lace 314. Rather, as the wearer draws their foot 500 out of the article of footwear 300, a force 502 is imparted on slidable securing device 302, forcing the slidable securing device 302 down the track 308 and imparting a force 504 on the lace 314. As a result, the vertical distance 408 between the lace guides 312 increases. Alternatively, the friction imparted on the lace 314 by the lace guides 312 and other components is may not be sufficient and when the lace 314 unspools from the spool 214 the vertical distance 408 between the lace guides 312 may begin to increase owing to forces imparted on the lace guides 312 and lace 314 without the wearer beginning to draw their foot 500 out of the article of footwear 300.

In FIG. 5B, the slidable securing device 302 is at the proximal end 404 of the track 308, the throat 304 is in a fully-opened configuration, and the article of footwear 300 is no longer secured to the foot 500. The wearer is free to fully remove their foot 500 from the article of footwear 300.

Figure 6A:
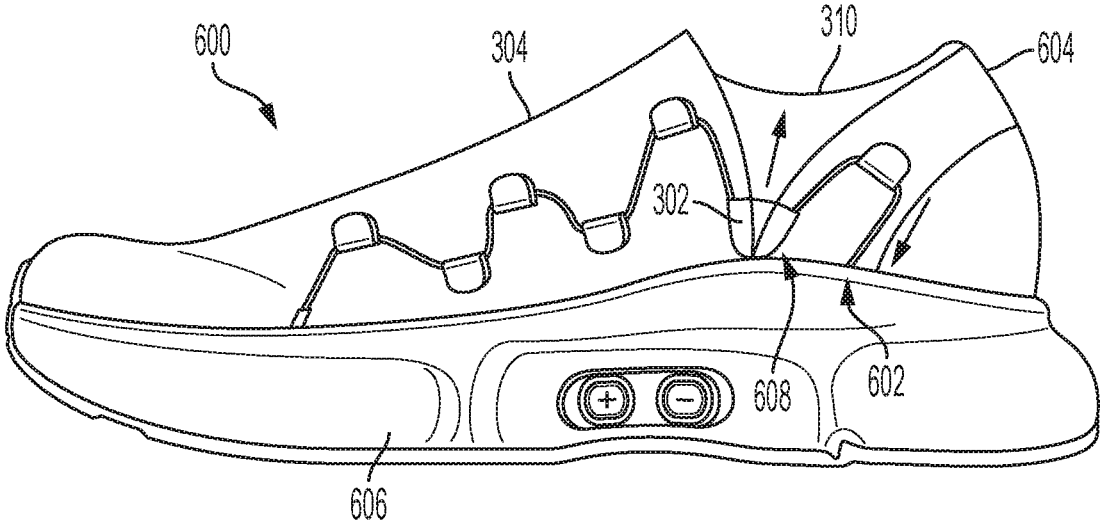
FIGS. 6A and 6B illustrate an alternative location for a slidable securing device on an article of footwear, in an example embodiment.
Figure 6B:
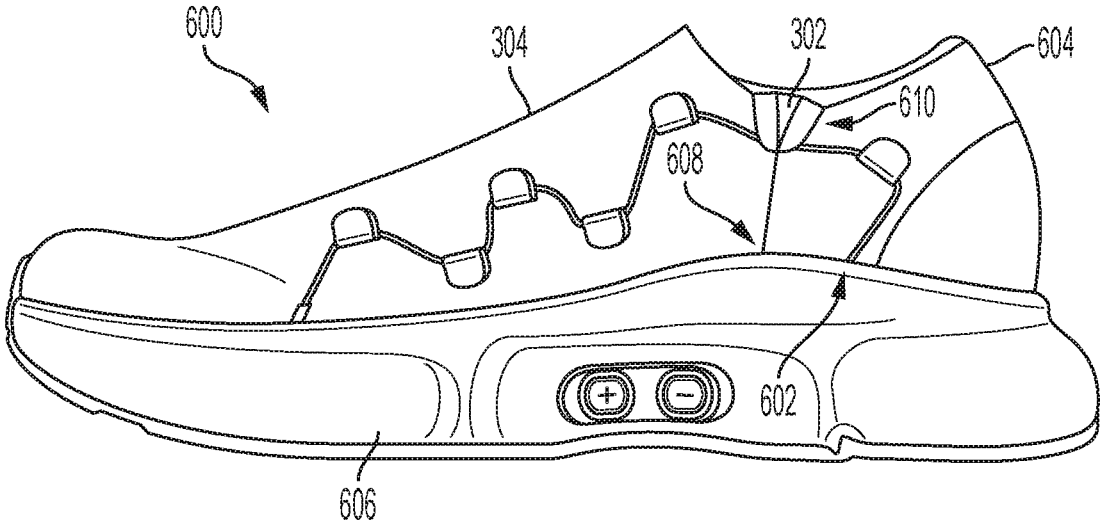

FIGS. 6A and 6B illustrate an alternative location for the slidable securing device 302 on an article of footwear 600, in an example embodiment. The article of footwear 600 may otherwise be the same as the article of footwear 300 and may include the same components. But rather than being positioned along the throat 304, the slidable securing device 302 is positioned at a midsole region 602 of the upper 604, extending from a sole 606 to the collar 310 of the upper 604. FIG. 6A illustrates the article of footwear 600 in a loosened state, with the slidable securing device 302 in a proximal location 608 near the sole 606. FIG. 6B illustrates the article of footwear 600 in a tightened state, with the slidable securing device 302 in a distal location 610 near the collar 310.

Figure 7A:
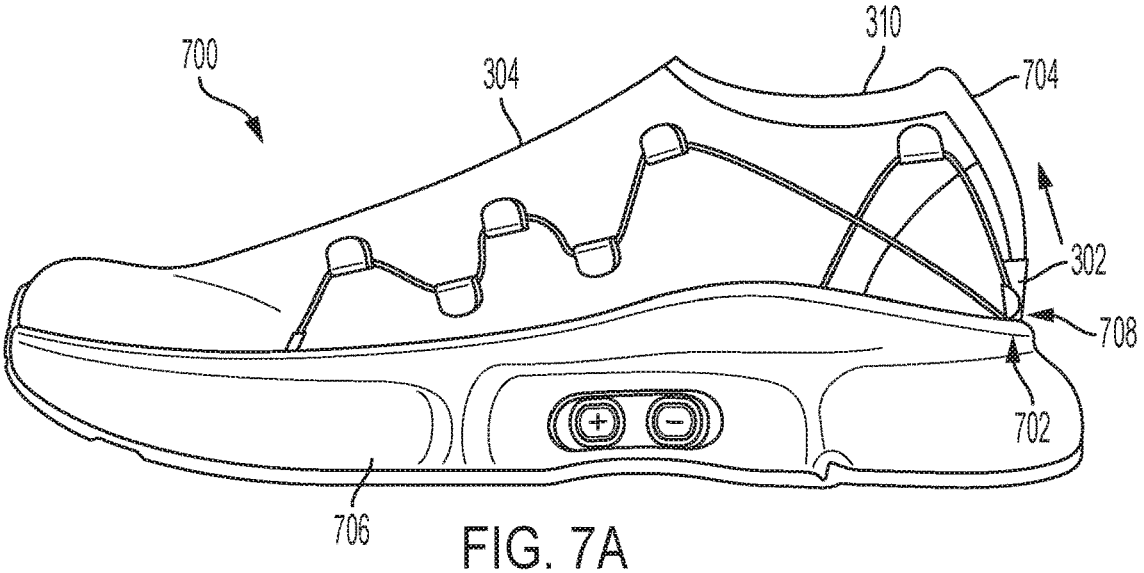
FIGS. 7A-7C illustrate an alternative location for a slidable securing device on an article of footwear, in an example embodiment.
Figure 7B:
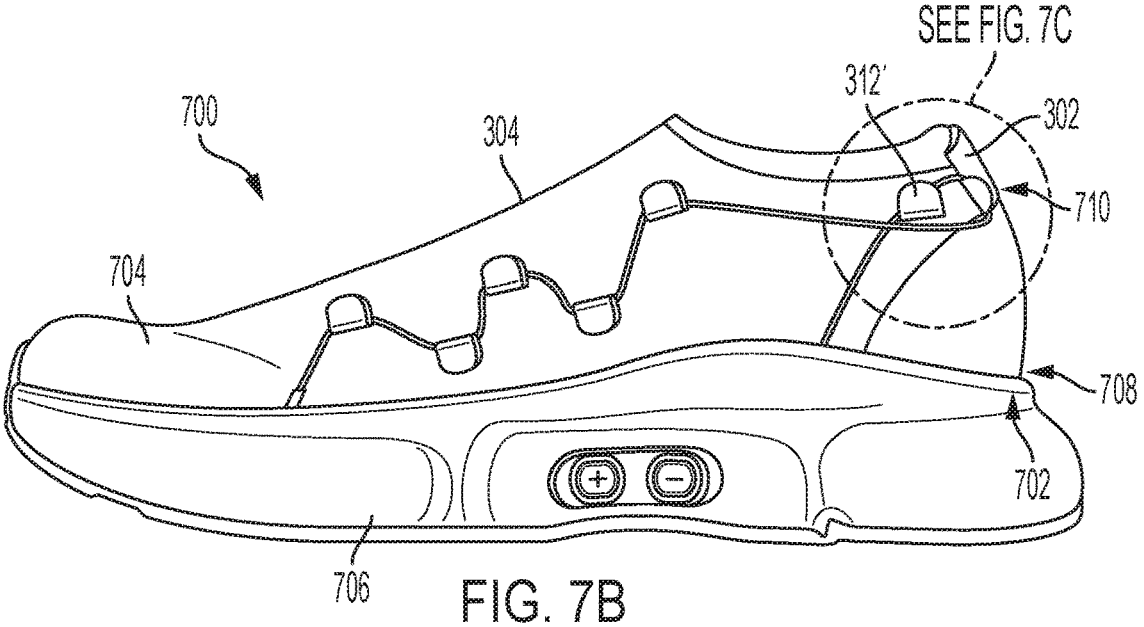
Figure 7C:
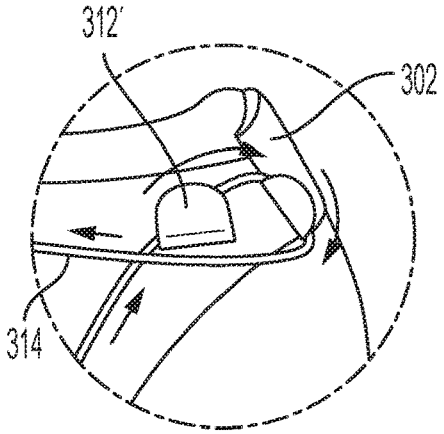

FIGS. 7A-7C illustrate an alternative location for the slidable securing device 302 on an article of footwear 700, in an example embodiment. The article of footwear 700 may otherwise be the same as the articles of footwear 300 and 600 and may include the same components. But rather than being positioned along the throat 304 or at the midsole region 602, the slidable securing device 302 is positioned at a heel region 702 of the upper 704, extending from a sole 706 to the collar 310 of the upper 704. FIG. 7A illustrates the article of footwear 700 in a loosened state, with the slidable securing device 302 in a proximal location 708 near the sole 706. FIG. 7B illustrates the article of footwear 700 in a tightened state, with the slidable securing device 302 in a distal location 710 near the collar 310. FIG. 7B includes an inset, detailed depiction of the movement of the lace 314 through the slidable securing device 302 and heel lace guide 312' in the tightened state.

While the articles of footwear 300, 600, 700 illustrate various specific embodiments, it is to be recognized and understood that any of the various principles disclosed with respect to those articles of footwear 300, 600, 700 may be omitted or applied according to other suitable designs. Thus, for instance, the lacing architecture created by the various lace guides 312 may be a conventional cross-over design in which the lace 314 passes and forth over the throat 304. The slidable securing device 302 may be repositioned to any of a variety of suitable locations. The materials of the uppers 306, 604, 704 may be selected to provide elasticity or firmness in various regions to promote the securing of the article of footwear 300, 600, 700 to the foot 500.

Figure 8A:
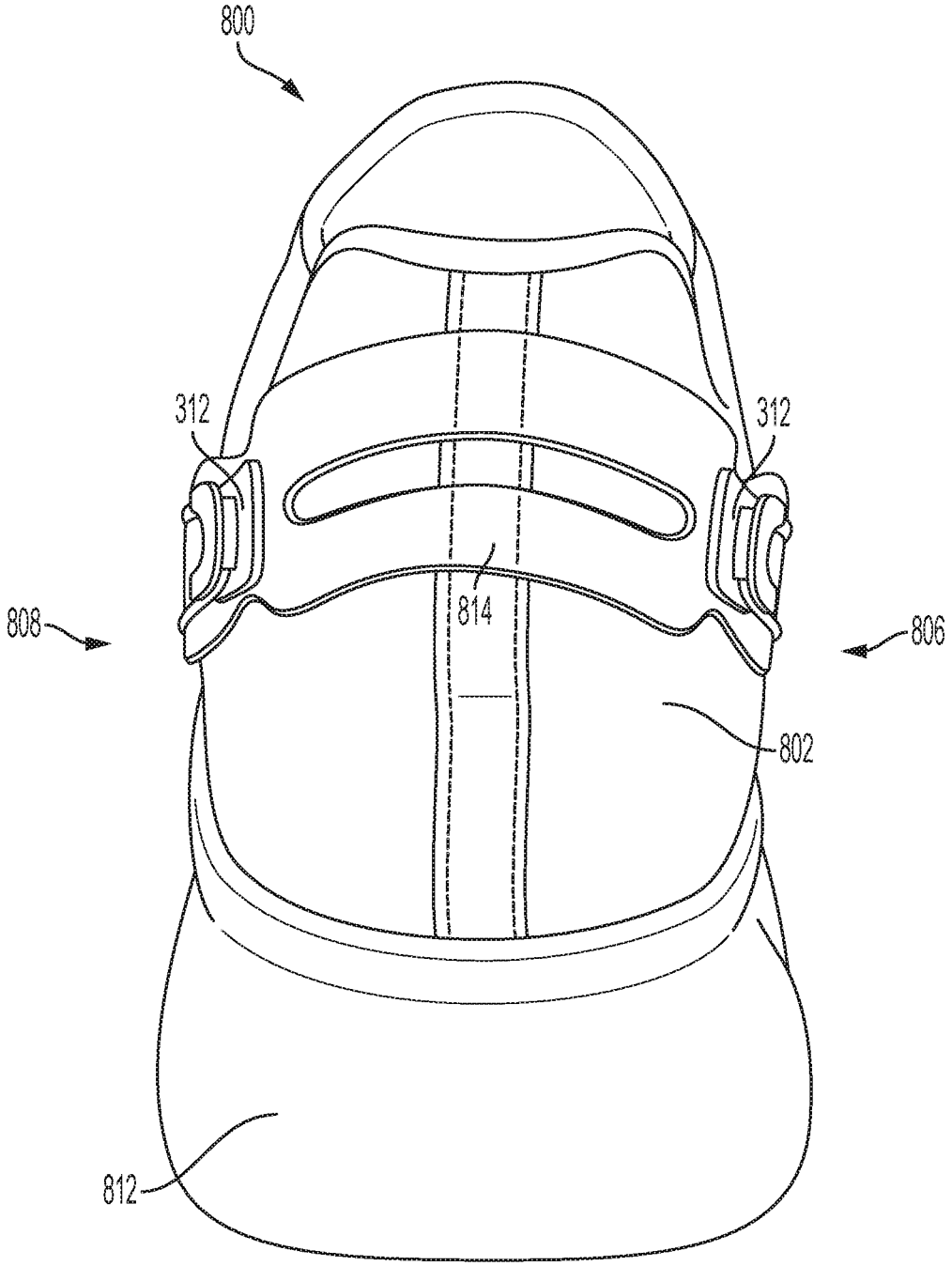
FIGS. 8A-8C illustrate a lacing architecture that may be utilized instead of or in combination with the lacing architecture of any of the articles of footwear, in various example embodiments.
Figure 8B:
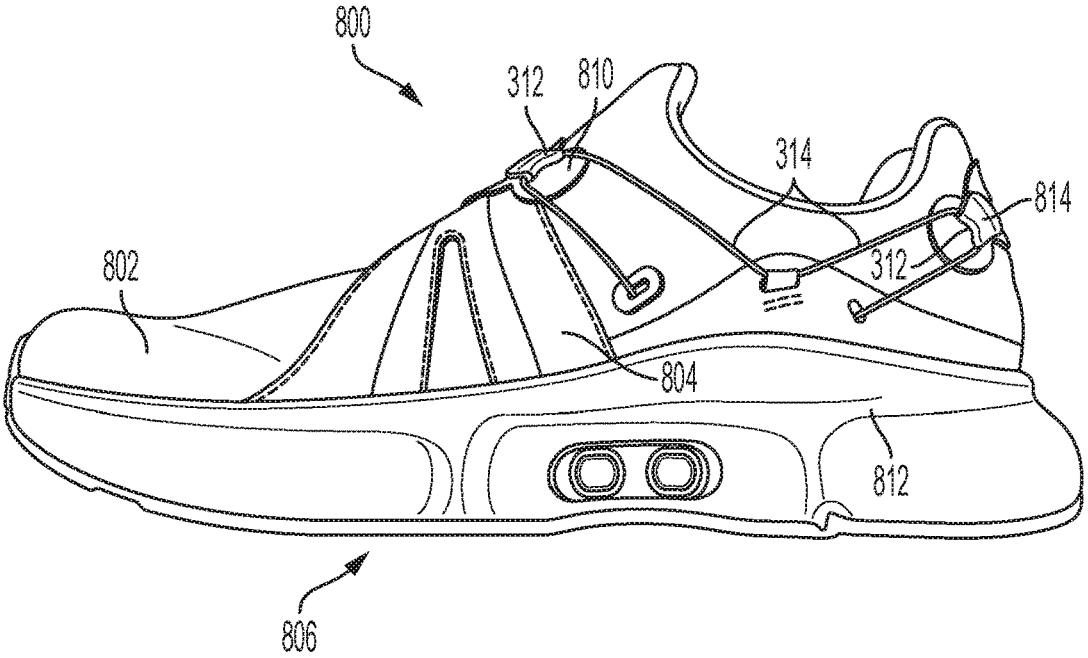
Figure 8C:
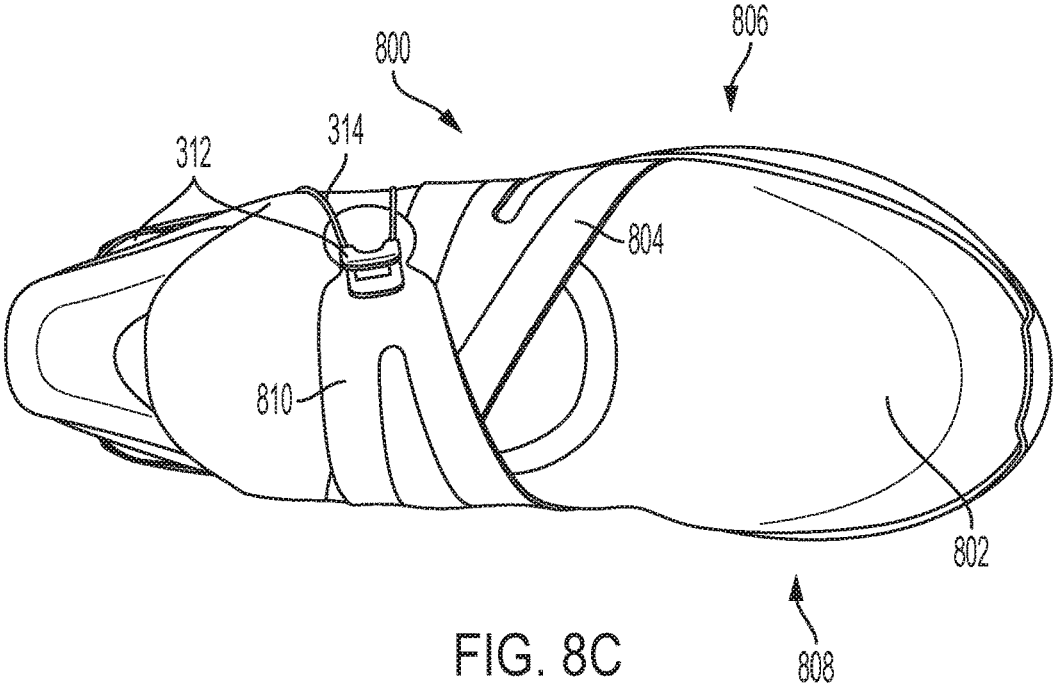

FIGS. 8A-8C illustrate a lacing architecture that may be utilized instead of or in combination with the lacing architecture of any of the articles of footwear 300, 600, 700, in various example embodiments. The article of footwear 800 includes an upper 802 having a first fold-over strip 804 extending from a lateral side 806 of the article of footwear 800 to a medial side 808 of the article of footwear 800 and a second fold-over strip 810 extending from the medial side 808 to the lateral side 806. Each of the fold-over strips 804, 810 extending from a sole 812 of the article of footwear 800. The first fold-over strip 804 includes a lace guide 312. In various examples, the second fold-over strip 810 may include a lace guide 312 (obscured), or the second fold-over strip 810 may be secured either to the upper 802 or to the sole 812. A heel strip 814 includes additional lace guides 312.

As with the article of footwear 300, a midsection of the lace 314 is engaged with the spool 214 (not pictured). When the motor 212 (not pictured) turns the spool 214 force is imparted on the lace 314 which is transferred to the lace guides 312. In the case of the article of footwear 800, force is applied to the heel strip 814 and the first fold-over strip 804 and, in various examples, the second fold-over strip 810. The force on the respective lace guides 312 cinches the heel strip 814 and the fold-over strips 804, 810 over the upper 802 and secures a foot within the article of footwear 800.

While additional lace guides 312 are not illustrated, it is noted that the lace 314 enters the upper 802 at an entry point, and that where the upper 802 includes an interior layer and an exterior layer that form a pocket within the upper, additional lace guides 312 may be positioned with the pocket. As such, the lacing architecture may additional be included within the upper and out of external view.

While the illustrated example article of footwear 800 does not specifically illustrate a slidable securing device 302, it is to be recognized and understood that the slidable securing device 302 may be implemented within this architecture according to the principles disclosed with respect to the articles of footwear 300, 600, 700. Thus, the slidable securing device 302 may be positioned according to the various positioning illustrated on the articles of footwear 300, 600, 700, or according to any suitable position on the article of footwear 800.

EXAMPLES

In Example 1, an article of footwear includes a midsole, an upper, secured with respect to the midsole, forming an opening to admit a foot of a wearer, the opening being adjustable between a first segment of the upper and a second segment of the upper to secure the article of footwear to the foot of the wearer, a slidable securing device, coupled between the first segment and the second segment of the upper, configured to slide along a length of track and secure the first and second segments together, a motorized lacing system positioned within the midsole, configured to engage with a lace to increase and decrease tension on the lace, the motorized lacing system comprising a motor and a lace spool, operatively coupled to the motor, configured to spool and unspool the lace to increase and decrease the tension on the lace, respectively, wherein the lace is secured to the slidable securing device, and wherein, when tension is placed on the lace, the lace causes the slidable securing device to slide along the track and secure the first and second segments together.

In Example 2, the article of footwear of Example 1 optionally further includes that the slidable securing device comprises a zipper.

In Example 3, the article of footwear of any one or more of Examples 1 and 2 optionally further includes that the upper comprises a throat, and wherein the first and second segments are coupled to opposing sides of the throat.

In Example 4, the article of footwear of any one or more of Examples 1-3 optionally further includes that the first and second segments are on opposing sides of an opening on a medial or lateral side of the article of footwear.

In Example 5, the article of footwear of any one or more of Examples 1-4 optionally further includes that the first and second segments are on opposing sides of an opening on heel counter of the article of footwear.

In Example 6, the article of footwear of any one or more of Examples 1-5 optionally further includes a plurality of lace guides secured on the upper, the lace extending through the plurality of lace guides, wherein the upper is configured such that applying tension to the lace further causes a portion of the upper to contract.

In Example 7, the article of footwear of any one or more of Examples 1-6 optionally further includes that the upper is configured such that applying tension to the lace causes the portion of the upper to contract after the slidable securing device has slid along the track.

In Example 8, the article of footwear of any one or more of Examples 1-7 optionally further includes that the upper is configured such that applying the tension to the lace causes the portion of the upper to contract after the slidable securing device has stopped sliding along the track.

In Example 9, the article of footwear of any one or more of Examples 1-8 optionally further includes that the upper is configured such that removing the foot from the opening when the motor has unspooled the lace causes the slidable securing device to slide in an opposite direction along the track.

In Example 10, the article of footwear of any one or more of Examples 1-9 optionally further includes that the upper is configured such that causing the portion of the upper to contract reduces a vertical distance between adjacent lace guides.

In Example 11, a method includes securing an upper with respect to a midsole, forming an opening to admit a foot of a wearer, the opening being adjustable between a first segment of the upper and a second segment of the upper to secure the article of footwear to the foot of the wearer, coupling a slidable securing device between the first segment and the second segment of the upper, the slidable securing device configured to slide along a length of track and secure the first and second segments together, positioning a motorized lacing system positioned within the midsole, the motorized lacing system configured to engage with a lace to increase and decrease tension on the lace, the motorized lacing system comprising a motor and a lace spool, operatively coupled to the motor, configured to spool and unspool the lace to increase and decrease the tension on the lace, respectively, securing the lace is secured to the slidable securing device, wherein, when tension is placed on the lace, the lace causes the slidable securing device to slide along the track and secure the first and second segments together.

In Example 12, the method of Example 11 optionally further includes that the slidable securing device comprises a zipper.

In Example 13, the method of any one or more of Examples 11 and 12 optionally further includes that the upper comprises a throat, and wherein the first and second segments are coupled to opposing sides of the throat.

In Example 14, the method of any one or more of Examples 11-13 optionally further includes that the first and second segments are on opposing sides of an opening on a medial or lateral side of the article of footwear.

In Example 15, the method of any one or more of Examples 11-14 optionally further includes that the first and second segments are on opposing sides of an opening on heel counter of the article of footwear.

In Example 16, the method of any one or more of Examples 11-15 optionally further includes a plurality of lace guides secured on the upper, the lace extending through the plurality of lace guides, wherein the upper is configured such that applying tension to the lace further causes a portion of the upper to contract.

In Example 17, the method of any one or more of Examples 11-16 optionally further includes that the upper is configured such that applying tension to the lace causes the portion of the upper to contract after the slidable securing device has slid along the track.

In Example 18, the method of any one or more of Examples 11-17 optionally further includes that the upper is configured such that applying the tension to the lace causes the portion of the upper to contract after the slidable securing device has stopped sliding along the track.

In Example 19, the method of any one or more of Examples 11-18 optionally further includes that the upper is configured such that removing the foot from the opening when the motor has unspooled the lace causes the slidable securing device to slide in an opposite direction along the track.

In Example 20, the method of any one or more of Examples 11-19 optionally further includes that the upper is configured such that causing the portion of the upper to contract reduces a vertical distance between adjacent lace guides.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of components, modules, or mechanisms. Modules may constitute either software modules (e.g., code embodied on a machine-readable medium or in a transmission signal) or hardware modules. A "hardware module" is a tangible unit capable of performing certain operations and may be configured or arranged in a certain physical manner. In various example embodiments, one or more computer systems (e.g., a standalone computer system, a client computer system, or a server computer system) or one or more hardware modules of a computer system (e.g., a processor or a group of processors) may be configured by software (e.g., an application or application portion) as a hardware module that operates to perform certain operations as described herein.

In some embodiments, a hardware module may be implemented mechanically, electronically, or any suitable combination thereof. For example, a hardware module may include dedicated circuitry or logic that is permanently configured to perform certain operations. For example, a hardware module may be a special-purpose processor, such as a field programmable gate array (FPGA) or an ASIC. A hardware module may also include programmable logic or circuitry that is temporarily configured by software to perform certain operations. For example, a hardware module may include software encompassed within a general-purpose processor or other programmable processor. It will be appreciated that the decision to implement a hardware module mechanically, in dedicated and permanently configured circuitry, or in temporarily configured circuitry (e.g., configured by software) may be driven by cost and time considerations.

Accordingly, the phrase "hardware module" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented module" refers to a hardware module. Considering embodiments in which hardware modules are temporarily configured (e.g., programmed), each of the hardware modules need not be configured or instantiated at any one instance in time. For example, where a hardware module comprises a general-purpose processor configured by software to become a special-purpose processor, the general-purpose processor may be configured as respectively different special-purpose processors (e.g., comprising different hardware modules) at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple hardware modules exist contemporaneously, communications may be achieved through signal transmission (e.g., over appropriate circuits and buses) between or among two or more of the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions described herein. As used herein, "processor-implemented module" refers to a hardware module implemented using one or more processors.

Similarly, the methods described herein may be at least partially processor-implemented, a processor being an example of hardware. For example, at least some of the operations of a method may be performed by one or more processors or processor-implemented modules. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an application program interface (API)).

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

Some portions of this specification are presented in terms of algorithms or symbolic representations of operations on data stored as bits or binary digital signals within a machine memory (e.g., a computer memory). These algorithms or symbolic representations are examples of techniques used by those of ordinary skill in the data processing arts to convey the substance of their work to others skilled in the art. As used herein, an "algorithm" is a self-consistent sequence of operations or similar processing leading to a desired result. In this context, algorithms and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or any suitable combination thereof), registers, or other machine components that receive, store, transmit, or display information. Furthermore, unless specifically stated otherwise, the terms "a" or "an" are herein used, as is common in patent documents, to include one or more than one instance. Finally, as used herein, the conjunction "or" refers to a non-exclusive "or," unless specifically stated otherwise.

What is claimed is:

1. An article of footwear, comprising:

a midsole;

an upper, secured with respect to the midsole, forming an opening to admit a foot of a wearer, the opening being adjustable between a first segment of the upper and a second segment of the upper to secure the article of footwear to the foot of the wearer;

a slidable securing device, coupled between the first segment and the second segment of the upper, configured to slide along a length of track and attach an edge of the first segment directly to an edge of the second segment together via the slidable securing device; and a motorized lacing system positioned within the midsole, configured to engage with a lace to increase and decrease tension on the lace, the motorized lacing system comprising:

a motor; and a lace spool, operatively coupled to the motor, configured to spool and unspool the lace to increase and decrease the tension on the lace, respectively;

wherein the lace is secured to the slidable securing device by entering an exiting the slidable securing device at a first end of the slidable securing device, and wherein, when tension is placed on the lace, the lace causes the slidable securing device to slide along the track and secure the first and second segments together.

2. The article of footwear of claim 1, wherein the slidable securing device comprises a zipper.

3. The article of footwear of claim 1, wherein the upper comprises a throat, and wherein the first and second segments are coupled to opposing sides of the throat.

4. The article of footwear of claim 1, wherein the first and second segments are on opposing sides of an opening on a medial or lateral side of the article of footwear.

5. The article of footwear of claim 1, wherein the first and second segments are on opposing sides of an opening on heel counter of the article of footwear.

6. The article of footwear of claim 1, further comprising a plurality of lace guides secured on the upper, the lace extending through the plurality of lace guides, wherein applying tension to the lace further causes a portion of the upper to contract.

7. The article of footwear of claim 6, wherein applying tension to the lace causes the portion of the upper to contract after the slidable securing device has slid along the track.

8. The article of footwear of claim 7, wherein applying the tension to the lace causes the portion of the upper to contract after the slidable securing device has stopped sliding along the track.

9. The article of footwear of claim 7, wherein the upper is configured such that removing the foot from the opening when the motor has unspooled the lace causes the slidable securing device to slide in an opposite direction along the track.

10. The article of footwear of claim 6, wherein causing the portion of the upper to contract reduces a vertical distance between adjacent lace guides.

* * * * *